US007135842B2

(12) United States Patent
Banerjee et al.

(10) Patent No.: US 7,135,842 B2
(45) Date of Patent: Nov. 14, 2006

(54) VOLTAGE REGULATOR HAVING IMPROVED IR DROP

(75) Inventors: Jaideep Banerjee, Raipur (IN); Tushar S. Nandurkar, Jabalpur (IN)

(73) Assignee: Freescale Semiconductor, Inc., Austin, TX (US)

( * ) Notice: Subject to any disclaimer, the term of this patent is extended or adjusted under 35 U.S.C. 154(b) by 77 days.

(21) Appl. No.: 11/047,494

(22) Filed: Jan. 31, 2005

(65) Prior Publication Data

US 2006/0170402 A1 Aug. 3, 2006

(51) Int. Cl.
*G05F 1/565* (2006.01)

(52) U.S. Cl. ..... 323/275; 323/274; 323/280; 323/281

(58) Field of Classification Search ..... 323/265, 323/267, 268, 273–275, 280, 281, 349
See application file for complete search history.

(56) References Cited

U.S. PATENT DOCUMENTS 6,373,233 B1 4/2002 Bakker et al.
6,515,459 B1 * 2/2003 Ottinger et al. ..... 323/269
6,522,110 B1 * 2/2003 Ivanov ..... 323/267
6,677,735 B1 1/2004 Xi
6,690,147 B1 2/2004 Bonto
6,703,815 B1 3/2004 Biagi
6,710,583 B1 3/2004 Stanescu et al.
6,756,838 B1 6/2004 Wu et al.
6,784,725 B1 8/2004 Wadhwa et al.
2003/0214275 A1 11/2003 Biagi
2004/0164789 A1 8/2004 Leung et al.
2004/0178778 A1 9/2004 Bansal

* cited by examiner

*Primary Examiner*—Gary L Laxton
(74) *Attorney, Agent, or Firm*—Charles Bergere

(57) ABSTRACT

A regulated power source for supplying power to an external circuit includes a voltage sensing circuit and a voltage regulator. The voltage sensing circuit generates a feedback voltage by comparing voltage drops at a plurality of sense points within the external circuit. The feedback voltage is based on the maximum voltage drop at the sense points. The voltage regulator regulates the voltage supplied to the external circuit in accordance with the feedback voltage.

10 Claims, 5 Drawing Sheets

VOLTAGE REGULATOR HAVING IMPROVED IR DROP

BACKGROUND OF THE INVENTION

The present invention relates generally to a power source for supplying power to a circuit and, in particular, to a voltage regulator that uses a multi-sense feedback scheme to improve voltage (IR) drops.

For efficient and desirable operation of electrical circuits, a constant voltage supply must be maintained at all points of time. Power supplies are used for providing a constant voltage to such electrical circuits. These power supplies or regulated power sources, receive as input an unregulated voltage, which may vary with time due to operational parameters, and provide an output voltage, which is fixed in magnitude and therefore called a regulated voltage.

During the operation of an electrical circuit, the load attached to the regulated power source draws current from the regulated power source. The load can be a resistive load and its source can be the impedance of the power supply network. In certain cases, a voltage (IR) drop occurs resulting in a lower voltage at the load than at the regulated power source's output terminals. This voltage drop is a result of the current flowing through the impedance of the power supply network. As a result, the electrical circuit receives a supply voltage that is less than the desired voltage. Further, this voltage may be fluctuating. Such an unregulated supply voltage may lead to improper functioning of the electrical circuit. In particular, the IR drop may lead to problems such as reduced noise margin, static power consumption, and logic failures.

Conventionally, a regulated power source senses the voltage at its output terminals and regulates the voltage at this point. Systems prone to distribution voltage drops in the power supply network are provided with sense pins, which monitor the voltage at a load point. The monitoring of the voltage at the load point enables the regulated power source to adjust its output so that the voltage across the load is regulated.

Conventional systems provide for single point sensing, which works well when a single load element is placed across the regulated power source's output. In case of multiple loads, each load has to be connected across a single point for single point load sensing to work correctly. Also, the conventional systems do not necessarily sense the maximum voltage drop in the power distribution network before providing feedback from the regulated power sources to counter the voltage drop.

Accordingly, it is an object of the present invention to provide a voltage regulator having a multipoint feedback scheme to compensate for voltage drops.

BRIEF DESCRIPTION OF THE DRAWINGS

The following detailed description of preferred embodiments of the invention will be better understood when read in conjunction with the appended drawings. The present invention is illustrated by way of example and not limited by the accompanying figures, in which like references indicate similar elements.

DETAILED DESCRIPTION OF THE INVENTION

The detailed description in connection with the appended drawings is intended as a description of the presently preferred embodiments of the invention, and is not intended to represent the only form in which the present invention may be practiced. It is to be understood that the same or equivalent functions may be accomplished by different embodiments that are intended to be encompassed within the spirit and scope of the invention.

The present invention provides a regulated power source for supplying power to an external circuit. The regulated power source includes a voltage sensing circuit and a voltage regulator. The voltage sensing circuit identifies a maximum voltage drop amongst a plurality of voltage drops in the external circuit by sensing voltage drops at a plurality of sense points within the external circuit. The voltage regulator supplies power to the external circuit in accordance with the maximum voltage drop identified by the voltage sensing circuit.

In another embodiment of the present invention, the regulated power source includes a voltage sensing circuit and a voltage regulator. The voltage sensing circuit generates a feedback voltage by comparing voltage drops at a plurality of sense points within the external circuit. The voltage regulator regulates the voltage supplied to the external circuit in accordance with the feedback voltage.

In another embodiment of the present invention, a method to supply power to an external circuit is provided. The method includes sensing of voltage drops at more than two sense points within the external circuit, determining the maximum voltage drop from amongst the sensed voltage drops, and generating a voltage that powers the external circuit based on the determined maximum voltage drop.

The regulated power source of the present invention uses a multi-sense feedback scheme to improve compensation of voltage drop in a circuit. Multiple points in the power supply network are sensed and the voltage at a point having the largest voltage drop is provided as a feedback voltage to the voltage regulator. This multi-sense feedback scheme provides a reliable technique of generating a regulated voltage. Also, the technique is simple and may be implemented using Complementary Metal Oxide semiconductor (CMOS)/Bipolar CMOS (BiCMOS) technology.

The regulated power source is suitable for applications that have very stringent voltage drop/minimum voltage requirements. Further, the area penalty is negligible for fabrication of the regulated power source.

Figure 1:
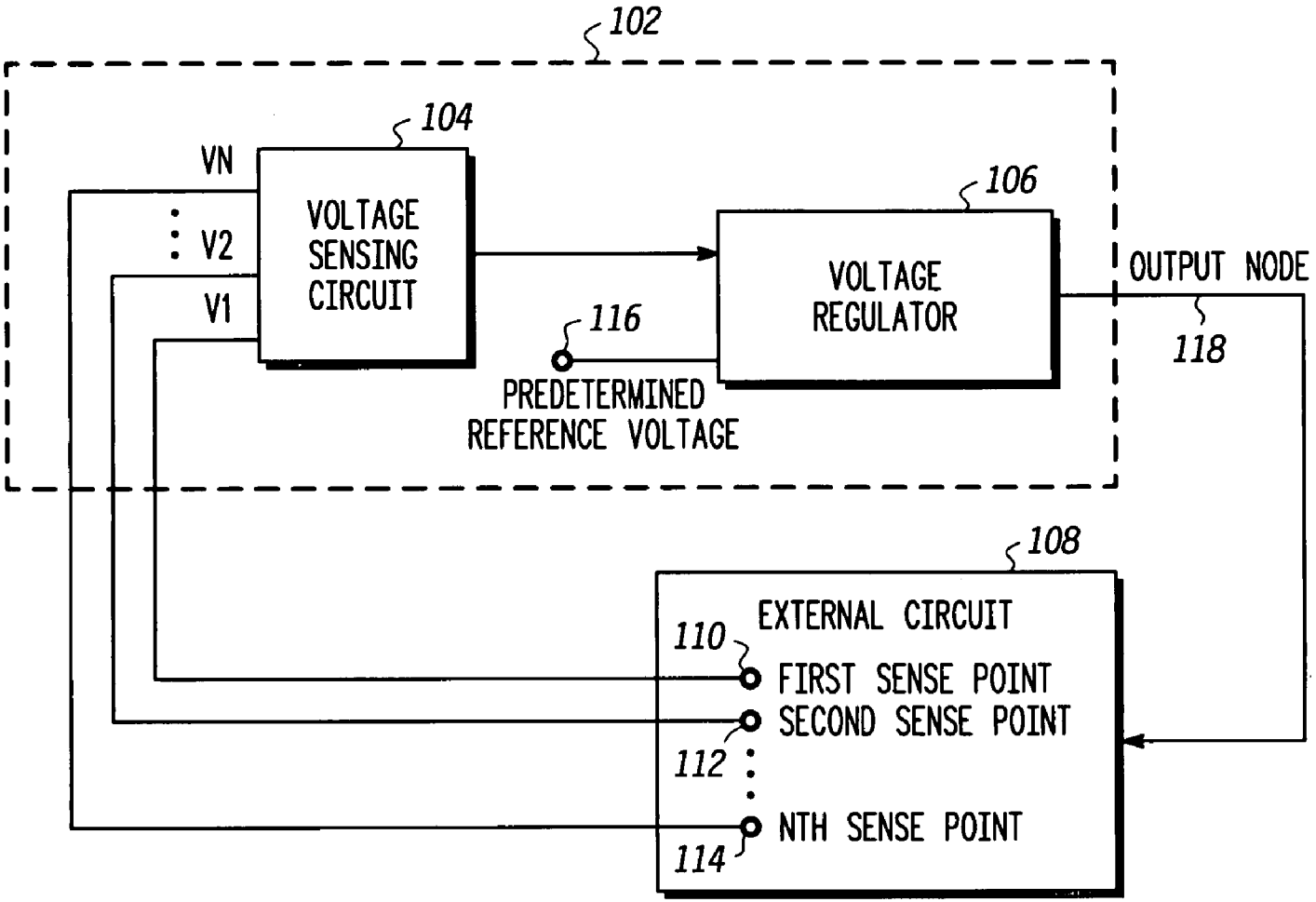
FIG. 1 is a high-level block diagram of a regulated power source in accordance with a first exemplary embodiment of the present invention.

Referring now to FIG. 1, a high-level block diagram of a regulated power source 102 in accordance with a first exemplary embodiment of the present invention is shown. The regulated power source 102 includes a voltage sensing circuit 104 and a voltage regulator 106. The regulated power source 102 supplies power to an external circuit 108.

The voltage sensing circuit 104 is coupled to the external circuit 108. In an embodiment of the present invention, the voltage sensing circuit 104 identifies a maximum voltage drop amongst a plurality of voltage drops in the external circuit 108 by sensing the plurality of voltage drops at a corresponding plurality of sense points within the external circuit 108. In another embodiment of the present invention, the voltage sensing circuit 104 generates an output, which is a feedback voltage. The feedback voltage is generated by comparing the voltage drops at the plurality of sense points within the external circuit 108.

In the embodiment shown, the external circuit 108 includes a first sense point 110, a second sense point 112, and a plurality of similar sense points up to an $N^{th}$ sense point 114. The voltage drop at the sense points 110, 112 and 114 is sensed. The sensed voltages, i.e., the voltages at the first, second and $N^{th}$ sense points 110, 112, and 114 are $V_1$, $V_2$, and $V_n$, respectively. The voltage sensing circuit 104 measures the voltages $V_1$, $V_2$, and $V_n$ and identifies a maximum voltage drop thereof.

The voltage regulator 106 has a first input node coupled to an output node of the voltage sensing circuit 104. The voltage of the sense point having the maximum voltage drop, as identified by the voltage sensing circuit 104, is passed to the voltage regulator 106 by way of the first input node. The voltage regulator 106 has a second input node connected to a predetermined reference voltage 116. The voltage regulator 106 generates a voltage at an output node 118 and supplies the output node voltage to the external circuit 108. The output node voltage is based on the maximum voltage drop identified by the voltage sensing circuit 104.

Figure 2:
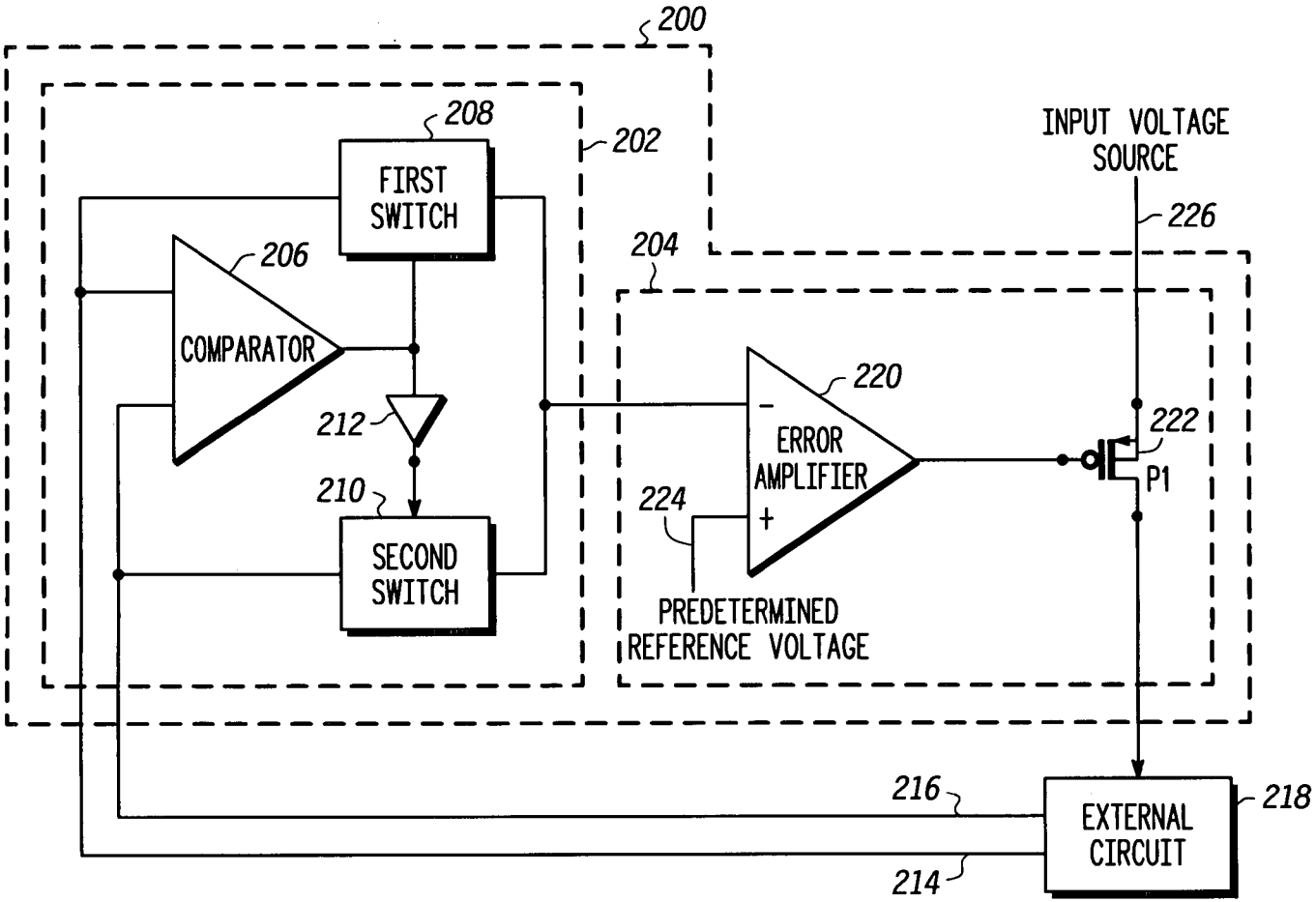
FIG. 2 is a schematic block diagram of a regulated power source in accordance with a second exemplary embodiment of the present invention.

FIG. 2 is a schematic block diagram of a regulated power source 200 in accordance with a second exemplary embodiment of the present invention. The regulated power source 200 includes a voltage sensing circuit 202 and a voltage regulator 204.

The voltage sensing circuit 202 includes a comparator 206, a first-switch 208, a second switch 210, and an inverter 212. The voltage sensing circuit 202 receives first and second sense voltages, which are the voltages at a first sense point 214 and a second sense point 216, respectively, of an external circuit 218. The comparator 206 has a first input coupled to the first sense point 214 of the external circuit 218 and a second input coupled to the second sense point 216 of the external circuit 218. The comparator 206 senses a minimum or the lower of the voltages at the first and second inputs, i.e., the maximum of the voltage drops at the first and second inputs, and generates an output signal indicative thereof.

The first switch 208 is connected to both the first input of the comparator 206 and the output of the comparator 206. An output node of the first switch 208 provides an output of the voltage sensing circuit 202 when the voltage at the first input of the comparator 206 is less than the voltage at the second input of the comparator 206. In an embodiment of the present invention, the output of the voltage sensing circuit 202 is a feedback voltage. The first switch 208 may comprise a transmission gate or a pass gate.

The inverter 212 has an input coupled with the output of the comparator 206 and an output coupled to an input of the second switch 210. A second input of the second switch 210 is connected to the second input of the comparator 206. An output node of the second switch 210 provides the output of the voltage sensing circuit 202 when the voltage at the second input of the comparator 206 is less than the voltage at the first input of the comparator 206. The second switch 210 may comprise a transmission gate or a pass gate.

The voltage regulator 204 includes an error amplifier 220 and a transistor 222, which may be a PMOS transistor. The error amplifier 220 has a first, negative input coupled to an output of the voltage sensing circuit 202 and a second, positive input coupled to a predetermined accurate reference voltage ($V_{ref}$) 224. An output of the error amplifier 220 is connected to a gate of the PMOS transistor 222. A source of the PMOS transistor 222 is connected to an unregulated input voltage source 226. A drain of the PMOS transistor 222 providing the output of the regulated power source 200. Based on the input voltage at the first input of the error amplifier 220, an output voltage is generated at the output of the regulated power source 200. This output voltage is provided to the external circuit 218 to compensate for the maximum voltage drop amongst the sensed voltage drops. The input voltage source 226 is an external unregulated supply to the voltage regulator and the reference voltage is an accurate voltage source, but with relatively low drive capacity compared to the voltage regulator.

Figure 3:
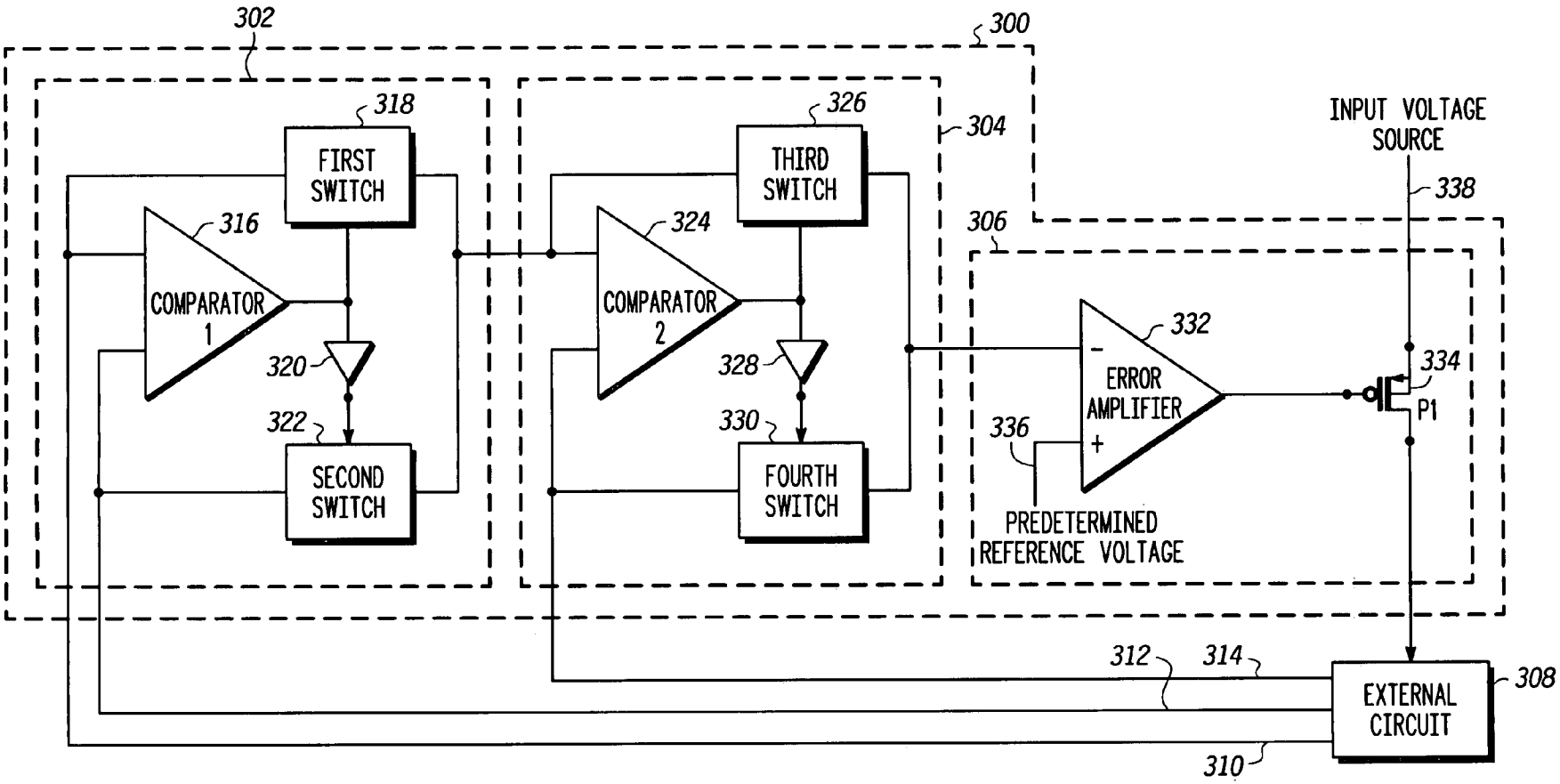
FIG. 3 is a schematic block diagram of a regulated power source in accordance with a third exemplary embodiment of the present invention.

FIG. 3 is a block diagram of a regulated power source 300 in accordance with a third exemplary embodiment of the present invention. The regulated power source 300 includes a first voltage sensing circuit 302, a second voltage sensing circuit 304, and a voltage regulator 306. An external circuit 308 includes first, second, and third sense points 310, 312, and 314, respectively. The first and second sense points 310 and 312 are connected to the inputs of the first voltage sensing circuit 302. The second voltage sensing circuit 304 has a pair of inputs connected to the third sense point 314 and an output of the first voltage sensing circuit 302, respectively. A first input of the voltage regulator 306 is connected to an output of the second voltage sensing circuit 304 and an output of the voltage regulator provides a regulated voltage to the external circuit 308.

The first voltage sensing circuit 302 includes a first comparator 316, a first switch 318, a first inverter 320, and a second switch 322. The first voltage sensing circuit 302 receives the first and second sense voltages, which are the voltages at the first sense point 310 and the second sense point 312, respectively. The first comparator 316 senses a minimum of the voltages at the first sense point 310 and the second sense point 312. The first switch 318 is connected between an output of the first comparator 316 and the first sense point 310. An output node of the first switch 318 provides an output of the first voltage sensing circuit 302 when the voltage at the first input of the first comparator 316 is less than the voltage at the second input of the first comparator 316. The first switch 318 may comprise a transmission gate or a pass gate.

The first inverter 320 has an input coupled to the output of the first comparator 316 and an output coupled to a first input of the second switch 322. A second input of the second switch 322 receives the second sense voltage. An output node of the second switch 322 provides the output of the first voltage sensing circuit 302 when the voltage at the second input of the first comparator 316 is less than the voltage at the first input of the first comparator 316. In an embodiment of the present invention, the second switch 322 includes a transmission gate or a pass gate.

The second voltage sensing circuit 304 includes a second comparator 324, a third switch 326, a second inverter 328, and a fourth switch 330. The second voltage sensing circuit 304 receives the output of the first voltage sensing circuit 302 and a third sense voltage, which is the voltage at the third sense point 314. The second voltage sensing circuit 304 operates in a manner similar to the first voltage sensing circuit 302. More particularly, the third switch 326 is connected between the output of the second comparator 324 and the first input of the second comparator 324, which is the output of the first voltage sensing circuit 302. The fourth switch 330 is connected between the inverter 328 and the second input of the second comparator 324, which is the third sense voltage. The inverter 328 inverts the output of the second comparator 324. The output of the second sense circuit 304 is provided by the third switch 326 when the comparator 324 first input is less than the comparator 324 second input. The output of the second sense circuit 304 is provided by the fourth switch 330 when the comparator 324 second input is less than the comparator 324 first input.

The voltage regulator 306 includes an error amplifier 332 and a transistor 334, such as a PMOS transistor. The error amplifier 332 has a first, negative input coupled to an output of the second voltage sensing circuit 304 and a second, positive input coupled to a predetermined reference voltage ($V_{ref}$) 336. An output of the error amplifier 332 is connected to a gate of the PMOS transistor 334. A source of the PMOS transistor 334 is connected to an input voltage source 338. The input voltage source 338 is an external unregulated supply to the regulator and the reference voltage is an accurate voltage source, but with relatively low drive capacity compared to the voltage regulator. A drain of the PMOS transistor 334 provides an output of the regulated power source 300. Based on the input voltage at the first input of the error amplifier 332, an output voltage is generated at the output of the regulated power source 300. The output voltage generated at the output of the regulated power source 300 is used to compensate for the voltage drops in the external circuit 308 in accordance with the maximum voltage drop measured at the sense points 310, 312 and 314.

Figure 4:
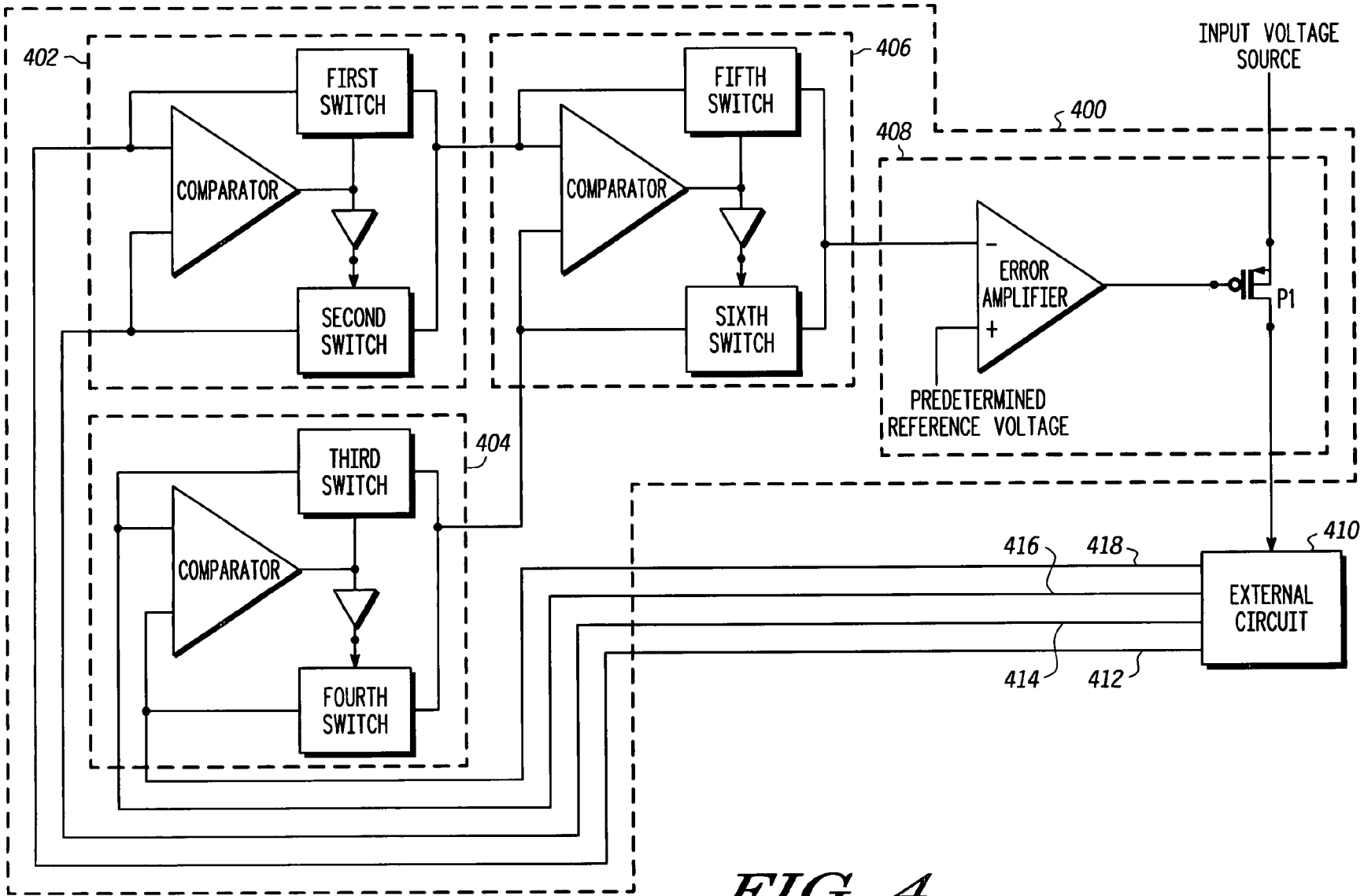
FIG. 4 is a schematic block diagram of a regulated power source in accordance with a fourth exemplary embodiment of the present invention.

FIG. 4 is a block diagram of a regulated power source 400 in accordance with a fourth exemplary embodiment of the present invention. The regulated power source 400 includes a first voltage sensing circuit 402, a second voltage sensing circuit 404, a third voltage sensing circuit 406, and a voltage regulator 408. The regulated power source 400 provides power to an external circuit 410 that has a first, second, third and fourth sense points 412, 414, 416 and 418 respectively.

The first, second and third voltage sensing circuits 402, 404 and 406 are similar to the first voltage sensing circuit 302 and the voltage regulator 408 is similar to the voltage regulator 306, both shown in FIG. 3 and described above.

The first voltage sensing circuit 402 receives first and second sense voltages, which are the voltages at the first sense point 412 and the second sense point 414, respectively. Similarly, the second voltage sensing circuit 404 receives third and fourth sense voltages, which are the voltages at the third sense point 416 and the fourth sense point 418, respectively. The third voltage sensing circuit 406 receives the outputs of the first and second voltage sensing circuits 402 and 404. The output of the third voltage sensing circuit 406 is coupled to the voltage regulator 408 that generates an output of the regulated power source 400. The output of the regulated power source 400 is provided to the external circuit 410 and compensates for the voltage drops thereof in accordance with a maximum voltage drop amongst the voltage drops at the sense points 412, 414, 416 and 418.

It should be noted that the regulated power source 400 may be implemented in other embodiments in which there are more than four sense points. The circuit configuration may be modified and additional voltage sensing circuits similar to the voltage sensing circuit 402 may be used when more than four sense points are used for determining the voltage drops at various points in the external circuit 410.

The PMOS transistor 334 (FIG. 3) or the PMOS transistor 222 (FIG. 2) supplies current to the external circuit 108, 218, 308 or 410 in accordance with the voltage difference between its gate voltage (output of error amplifier 332 or 220) and input voltage (voltage of input voltage source 226 or 338). It will be understood by those of skill in the art that the use of PMOS is not required and the other technologies may be used, such as PNP, Darlington pair, etc.

Figure 5:
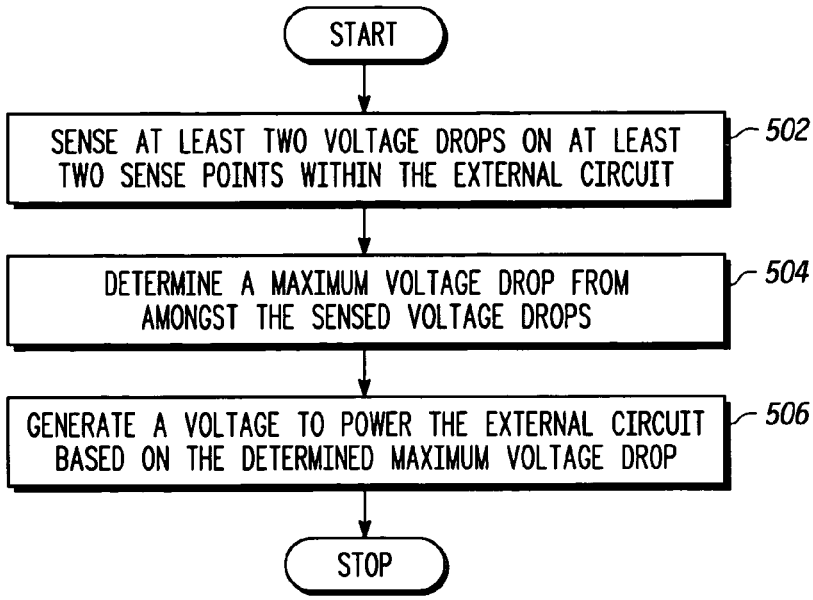
FIG. 5 is a flowchart illustrating a method for supplying power to an external circuit in accordance with an exemplary embodiment of the present invention.

FIG. 5 is a flowchart illustrating a method for supplying power to an external circuit in accordance with an exemplary embodiment of the present invention. At step 502, at least two voltage drops are sensed at at least two sense points within the external circuit. Then at step 504, a maximum voltage drop is determined from amongst the sensed voltage drops, i.e., the sense point having the minimum voltage is identified. Finally at step 506, a voltage is generated to power the external circuit based on the determined maximum voltage drop.

Figure 6:
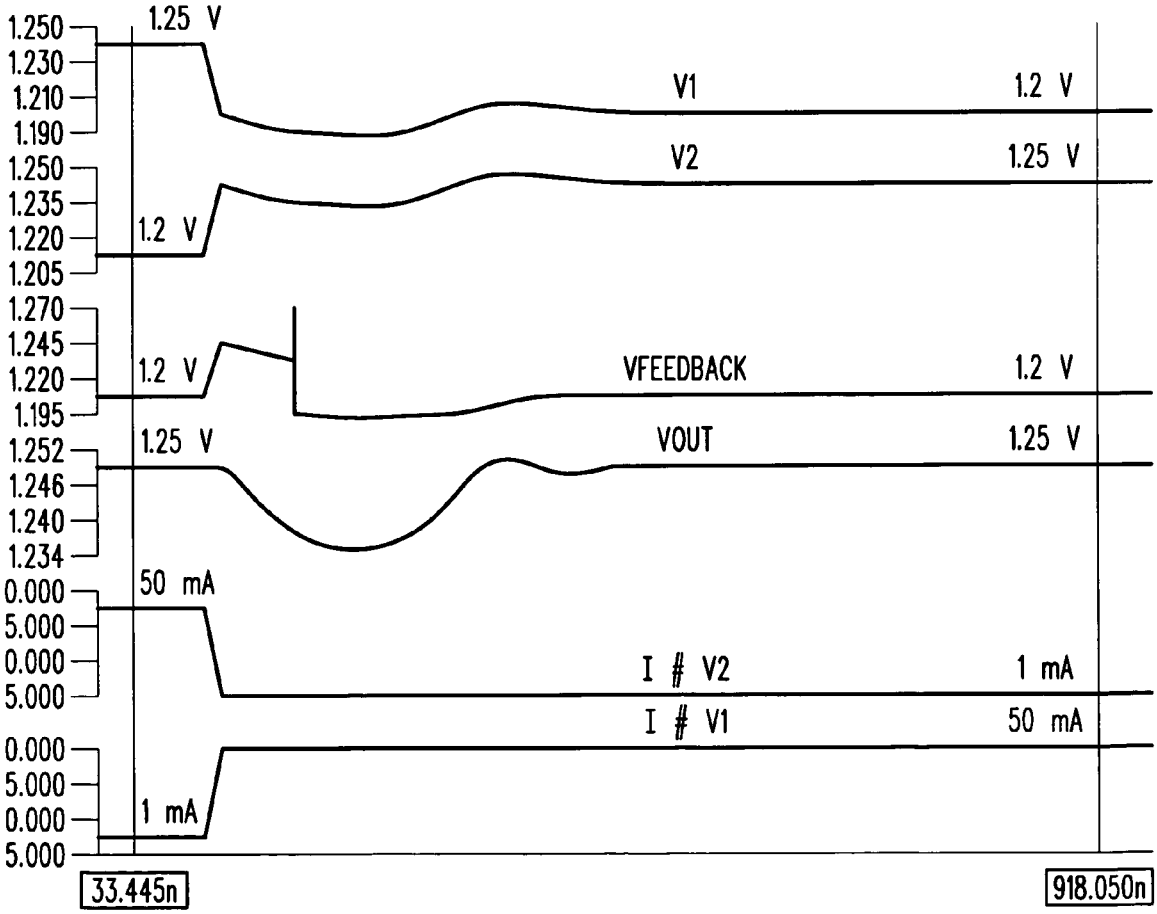
FIG. 6 is a waveform diagram illustrating variations in an output voltage and feedback voltage in accordance with the second exemplary embodiment of the present invention.

FIG. 6 is a waveform diagram illustrating variations in an output voltage and feedback voltage in accordance with the second exemplary embodiment of the present invention. The output voltage is the output voltage of the regulated power source 200 of FIG. 2 the feedback voltage is the output of the voltage sensing circuit 202 of FIG. 2. The waveform diagram shows variations in the output and feedback voltages with changing voltages at the sense points over time. The output voltage is represented as $V_{out}$ and feedback voltage is represented as $V_{feedback}$. The sense voltages at the sense points are represented by $V_1$ and $V_2$.

$V_1$ and $V_2$ are connected with $V_{out}$ by a resistance, which includes routing resistance of power lines. The reference voltage $V_{ref}$ is 1.2V. Both $V_1$ and $V_2$ are connected to $V_{out}$ by 10 hm routing resistance. Initially the load current on $V_1$ is 1 mA and the load current on $V_2$ is 50 mA. In this embodiment, $V_2$ is the point having a maximum voltage drop. At this instant, $V_2=V_{ref}=V_{feedback}=1.2V$.

The load current of $V_1$ then is changed from 1 mA to 50 mA and the load current of $V_2$ is changed to 1 mA. In this case, $V_1$ becomes the point having maximum voltage drop. FIG. 6 shows that after settling, $V_1=V_{ref}=V_{feedback}=1.2V$.

While various embodiments of the invention have been illustrated and described, it will be clear that the invention is not limited to these embodiments only. Numerous modifications, changes, variations, substitutions, and equivalents will be apparent to those skilled in the art, without departing from the spirit and scope of the invention, as described in the claims.

The invention claimed is:

1. A regulated power source for supplying power to an external circuit, comprising:

a voltage sensing circuit coupled to the external circuit for identifying a maximum voltage drop amongst a plurality of voltage drops in the external circuit by sensing the plurality of voltage drops at a plurality of sense points within the external circuit; and a voltage regulator having a first input node coupled to an output node of the voltage sensing circuit, and a second input node connected to a predetermined reference voltage, wherein the voltage regulator supplies power to the external circuit in accordance with the maximum voltage drop identified by the voltage sensing circuit;

wherein the voltage sensing circuit comprises:

a comparator having a first input coupled to a first sense point of the external circuit, a second input coupled to a second sense point of the external circuit, and an output, the comparator circuit sensing a lower one of the voltages at the first and second inputs;

a first switch connected to the comparator output, an output node of the first switch providing the output of the voltage sensing circuit when the voltage at the comparator first input is less than the voltage at the comparator second input;

an inverter having an input connected to the comparator output; and a second switch connected to an output of the inverter, an output node of the second switch providing the output of the voltage sensing circuit when the voltage at the comparator second input is less than the voltage at the comparator first input.

2. The regulated power source of claim 1, wherein the first switch comprises a transmission gate.

3. The regulated power source of claim 1, wherein the first switch comprises a pass gate.

4. The regulated power source of claim 1, wherein the second switch comprises a transmission gate.

5. The regulated power source of claim 1, wherein the second switch comprises a pass gate.

6. The regulated power source of claim 1, wherein the voltage regulator comprises:

an error amplifier having a first input node coupled to the output node of the voltage sensing circuit, a second input node coupled to the predetermined reference voltage, and an output node; and a PMOS transistor having a gate connected to the output node of the error amplifier, a source connected to an input voltage source, and a drain connected to an output node of the regulated power source.

7. The regulated power source of claim 1, wherein the number of sense points is greater than two.

8. The regulated power source of claim 1, wherein the voltage regulator comprises:

an error amplifier coupled to the voltage sensing circuit, the error amplifier having a first input that receives the output of the voltage sensing circuit and a second input coupled to a reference voltage.

9. The regulated power source of claim 8, wherein the voltage regulator further comprises:

a PMOS transistor having a gate connected to an output node of the error amplifier, a source connected to an input voltage source, and a drain connected to an output node of the regulated power source.

10. A regulated power source for supplying power to an external circuit, comprising:

a voltage sensing circuit coupled to the external circuit for identifying a maximum voltage drop amongst a plurality of voltage drops in the external circuit by sensing the plurality of voltage drops at a plurality of sense points within the external circuit; and a voltage regulator having a first input node coupled to an output node of the voltage sensing circuit, and a second input node connected to a predetermined reference voltage, wherein the voltage regulator supplies power to the external circuit in accordance with the maximum voltage drop identified by the voltage sensing circuit, wherein the number of sense points comprises three and the voltage sensing circuit comprises a first voltage sensing circuit having a pair of inputs coupled to the first and second sense points and a second voltage sensing circuit having a pair of inputs connected to the third sense point and an output of the first voltage sensing circuit, respectively, and the first input node of the voltage regulator is connected to an output of the second voltage sensing circuit.

* * * * *